US007373092B2

(12) United States Patent
Tawada

(10) Patent No.: US 7,373,092 B2
(45) Date of Patent: May 13, 2008

(54) METHOD AND APPARATUS FOR IMAGE FORMING CAPABLE OF EFFECTIVELY COLLECTING WASTE TONER

(75) Inventor: Takaaki Tawada, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 11/206,812

(22) Filed: Aug. 19, 2005

(65) Prior Publication Data

US 2006/0039710 A1 Feb. 23, 2006

(30) Foreign Application Priority Data

Aug. 19, 2004 (JP) ..... 2004-239275
Oct. 15, 2004 (JP) ..... 2004-301332

(51) Int. Cl.
*G03G 21/12* (2006.01)

(52) U.S. Cl. ..... 399/35; 399/120

(58) Field of Classification Search ..... 399/9, 399/34, 35, 107, 120, 343, 358, 359, 360
See application file for complete search history.

(56) References Cited

U.S. PATENT DOCUMENTS 6,505,009 B2 * 1/2003 Henricus et al. ..... 399/35
6,580,881 B2 * 6/2003 Coriale et al. ..... 399/35
6,640,061 B2 * 10/2003 Higgins et al. ..... 399/35
6,731,885 B2 * 5/2004 Anthony et al. ..... 399/35
6,819,885 B2 * 11/2004 Serizawa ..... 399/35
2004/0223782 A1 11/2004 Hosokawa et al.
2005/0019070 A1 1/2005 Suda et al.
2005/0074264 A1 4/2005 Amemiya et al.
2005/0084271 A1 4/2005 Koike et al.
2005/0084304 A1 4/2005 Kataoka et al.
2005/0152722 A1 7/2005 Tawada et al.

FOREIGN PATENT DOCUMENTS

JP 2002-148884 5/2002

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus includes an image carrying member, a transfer device, cleaning devices, and a waste toner collecting unit. The cleaning devices collect toner remaining on the image carrying member and toner remaining in the transfer device as waste toner after a toner image is transferred by the transfer device from the image carrying member to a recording medium. The waste toner collecting unit includes a container storing the waste toner, a conveying device provided in the container, and a detection unit provided above a position where the waste toner is pressed and up-thrust by the conveying device. The conveying device horizontally conveys the waste toner, and presses and up-thrusts the waste toner after an amount of the waste toner reaches a predetermined value. The detection unit is pressed and displaced by the pressed and up-thrust waste toner, and detected by a sensor.

40 Claims, 6 Drawing Sheets

METHOD AND APPARATUS FOR IMAGE FORMING CAPABLE OF EFFECTIVELY COLLECTING WASTE TONER

CROSS REFERENCE TO RELATED APPLICATIONS

This application claims priority to Japanese patent application nos. JP 2004-301332 filed on Oct. 15, 2004 and JP 2004-239275 filed on Aug. 19, 2004, the entire contents of each of which are hereby incorporated by reference herein.

BACKGROUND OF THE INVENTION

1. Field of the Invention

The present invention relates to a method and apparatus for image forming, and more particularly to a method and apparatus for image forming capable of effectively collecting waste toner generated in a toner image forming process.

2. Discussion of Background Art

In a background image forming apparatus, a toner image is formed on a surface of a photoconductor according to an electrographic method, and the toner image is transferred to a recording medium. In another background image forming apparatus (i.e., color image forming apparatus), toner images of different colors are formed on surfaces of a plurality of photoconductors according to the electrographic method. The toner images are sequentially transferred first to an intermediate transfer belt and then to a recording medium.

In these types of image forming apparatuses, toner remains on the surface of the photoconductor or the intermediate transfer belt after a toner image is transferred from the photoconductor or the intermediate transfer belt to the recording medium. The toner remaining on the surface of the photoconductor or the intermediate transfer belt is collected as waste toner by a cleaning device. The collected waste toner is stored in a waste toner collecting unit. When the waste toner collecting unit is filled or nearly filled with the waste toner, the waste toner collecting unit is detached from an image forming apparatus to be replaced by a new, unfilled waste toner collecting unit. Whether the waste toner collecting unit is filled or nearly filled with the waste toner is detected by a sensor.

In one of the background image forming apparatuses described above, a box-shaped, transparent toner storing container is provided on a bottom of the waste toner collecting unit. The toner storing container is set to a position between a light emitting part and a light acceptance part of an optical penetration sensor, when the waste toner collecting unit is attached to the image forming apparatus. The waste toner collecting unit includes a tube having an opening at an upper end in an upper area of the toner storing container. Thus configured, when the waste toner collecting unit is actually filled or nearly filled with the waste toner, the waste toner starts flowing out of the toner storing container from the opening at the upper end of the tube. As a result, light emitted from the light emitting part and received at the light acceptance part is intercepted. This interception of the light indicates that the waste toner collecting unit is filled or nearly filled with waste toner.

In this system, however, the waste toner may be stirred up due to impact caused when the waste toner is put in the waste toner collecting unit or due to rotation of a conveying member which conveys and levels the waste toner. Then, a part of the waste toner enters in the toner storing container from the opening at the upper end of the tube. As a result, the light emitted from the light emitting part is intercepted before the waste toner collecting unit is actually filled with the waste toner, and it may be incorrectly detected that the waste toner collecting unit has been filled or nearly filled with the waste toner.

Further, if one of waste toners of a plurality of colors (e.g., waste toner of the magenta color) put in the vicinity of the tube is relatively large in amount, this waste toner may accumulate more in the vicinity of the tube than in other parts of the waste toner collecting unit. As a result, this waste toner enters into the toner storing container through the tube and intercepts the light emitted from the light emitting part before the waste toner collecting unit is actually filled with the waste toner. Thus, a premature detection that the waste toner collecting unit is filled or nearly filled with the waste toner may result.

This incorrect detection leads to replacement of a waste toner collecting unit with a new waste toner collecting unit before the waste toner collecting unit is actually filled with waste toner. As a result, the replacement of waste toner collecting units takes place more often than necessary, thus increasing the cost of replacements. Further, the replacement of the waste toner collecting units interrupts use of the image forming apparatus. Therefore, operating efficiency of the image forming operation is reduced.

In this background image forming apparatus, the waste toner placed in the waste toner collecting unit is horizontally conveyed exclusively by a single conveying member. The single conveying member, however, has limited waste toner conveying power. Therefore, if a series of images of a relatively large image area are formed, and a relatively large amount of waste toner is successively put in the waste toner collecting unit, the waste toner is accumulated in a pile and stops more waste toner from entering the waste toner collecting unit.

SUMMARY OF THE INVENTION

This patent specification describes an image forming apparatus. In one non-limiting example, an image forming apparatus includes an image carrying member, a transfer device, first and second cleaning devices, and a waste toner collecting unit. The image carrying member rotates and carries a toner image thereon. The transfer device transfers the toner image to a recording medium. The first cleaning device collects toner remaining on the image carrying member as waste toner after a primary transfer operation of the toner image from the image carrying member to the transfer device. The second cleaning device collects toner remaining in the transfer device as waste toner after a secondary transfer operation of the toner image from the transfer device to the recording medium. The waste toner collecting unit stores the waste toner, and includes a container, a conveying device, and a detection unit. The container stores the waste toner collected by and conveyed from the first and second cleaning devices. The conveying device is provided in the container to horizontally convey the waste toner in the container and to press and up-thrust the waste toner after an amount of the waste toner reaches a predetermined value. The detection unit is provided above a position where the waste toner is pressed and up-thrust by the conveying device, and is pressed and displaced by the pressed and up-thrust waste toner to be detected by a sensor.

The image forming apparatus may further include a process cartridge. The process cartridge may be detachably provided in the image forming apparatus to store the image carrying member, and at least one of the first cleaning device, a charging device, and a development device. The charging device and the development device may form the toner image on the image carrying member according to an electrostatic photography method. The image carrying member may include a photoconductor.

In the image forming apparatus, the container may include first and second fill ports. The first fill port may be provided on an upper surface of the container above one end of the conveying device to receive the waste toner from one of the first and second cleaning devices. The second fill port may be provided on the upper surface of the container above another end of the conveying device to receive the waste toner from the other one of the first and second cleaning devices. The conveying device may include a screw member which rotates around an axis thereof to convey the waste toner placed in the container through the first and second fill ports toward a center of the container. The screw member may include a first spiral member extending from one end to a center or central area of the screw member, and a second spiral member extending from the other end to the center or central area of the screw member. The detection unit may be located above a position where the waste toner conveyed by the first spiral member collides with the waste toner conveyed by the second spiral member.

In the image forming apparatus, the container may include first and second fill ports. The first fill port may be provided on an upper surface of the container above one end of the conveying device to receive the waste toner from one of the first and second cleaning devices. The second fill port may be provided on the upper surface of the container above another end of the conveying device to receive the waste toner from the other one of the first and second cleaning devices. However, other locations of the fill ports are possible. The conveying device may include a screw member which rotates around an axis thereof to convey the waste toner put in the container through the first and second fill ports toward a center of the container. The screw member may include a first spiral member extending from one end to a center or central area of the screw member, and a second spiral member extending from the other end to the center or central area of the screw member, and having a waste toner conveying ability substantially equal to that of the first spiral member. The detection unit may be arranged in the vicinity of one of the first and second fill ports and closer to the center of the container than is one of the first and second fill ports.

In one non-limiting embodiment of the image forming apparatus, the first and second spiral members may have different lengths, and the detection unit may be arranged in the vicinity of one of the first and second fill ports which is closer to the shorter of the spiral members.

In another non-limiting embodiment of the image forming apparatus, the first and second spiral members may be substantially equal in length.

In one non-limiting embodiment of the image forming apparatus, the detection unit may include a flexible seal and a movable member. The flexible seal may be provided on an upper surface of the container to be pressed and upwardly bent by the pressed and up-thrust waste toner. The movable member may have one end supported by an outer surface of the container, and another end pressed and upwardly displaced by the upwardly bent flexible seal.

In the image forming apparatus, the container may include a leveling device. The leveling device may be provided in the container to level an upper surface of the waste toner in the container into a substantially flat surface.

This patent specification further describes an image forming method. In one example, an image forming method includes: forming a waste toner collecting unit by providing a conveying device in a container and a detection unit on an upper surface of the container; rotating an image carrying member which carries a toner image thereon; causing a transfer device to transfer the toner image to a recording medium; causing a first cleaning device to collect toner remaining on the image carrying member as waste toner after a primary transfer operation of the toner image from the image carrying member to the transfer device; causing a second cleaning device to collect toner remaining in the transfer device as waste toner after a secondary transfer operation of the toner image from the transfer device to the recording medium; storing the waste toner conveyed from the first and second cleaning devices in the container; causing the conveying device to horizontally convey the waste toner in the container and to press and up-thrust the waste toner, after an amount of the waste toner reaches a predetermined value, to press and displace the detection unit; and detecting the detection unit by a sensor.

In one non-limiting example of the image forming method, a process cartridge may be detachably provided in the image forming apparatus to store the image carrying member and at least one of the first cleaning device, a charging device, and a development device. The charging device and the development device may form the toner image on the image carrying member according to an electrostatic photography method. The image carrying member may also include a photoconductor.

In one non-limiting example of the image forming method, the container may include first and second fill ports. The first fill port may be provided on an upper surface of the container above one end of the conveying device to receive the waste toner from one of the first and second cleaning devices. The second fill port may be provided on the upper surface of the container above another end of the conveying device to receive the waste toner from the other of the cleaning devices. The conveying device may include a screw member which rotates around an axis thereof to convey the waste toner put in the container through the first and second fill ports toward a center or central area of the container. The screw member may include a first spiral member extending from one end to a center or central area of the screw member and a second spiral member extending from the other end to the center or central area of the screw member. The detection unit may be located above a position where the waste toner conveyed by the first spiral member collides with the waste toner conveyed by the second spiral member.

In another non-limiting example of the image forming method, the container may include first and second fill ports. The first fill port may be provided on an upper surface of the container above one end of the conveying device to receive the waste toner from one of the first and second cleaning devices. The second fill port may be provided on the upper surface of the container above another end of the conveying device to receive the waste toner from the other one of the first and second cleaning devices. However, other locations for the fill ports are possible. The conveying device may include a screw member which rotates around an axis thereof to convey the waste toner put in the container through the first and second fill ports toward a center or central area of the container. The screw member may include a first spiral member extending from one end to a center or central area of the screw member, and a second spiral member extending from the other end to the center or central area of the screw member and having a waste toner conveying ability substantially equal to that of the first spiral member. The detection unit may be arranged in the vicinity of one of the first and second fill ports and closer to the center of the container than the one of the first and second fill ports is.

In one non-limiting example of the image forming method, the first and second spiral members may have different lengths, and the detection unit may be arranged in the vicinity of one of the first and second fill ports which is closer to a shorter of the first and second spiral members.

In another non-limiting example of the image forming method, the first and second spiral members may be substantially equal in length.

In one example of the image forming method, the detection unit may include a flexible seal and a movable member. The flexible seal is typically provided on an upper surface of the container to be pressed and upwardly bent by the pressed and up-thrust waste toner. However, other locations are possible. The movable member may have one end supported by an outer surface of the container and another end pressed and upwardly displaced by the upwardly bent flexible seal.

In the image forming method, the container may include a leveling device. The leveling device may be provided in the container to level an upper surface of the waste toner in the container into a substantially flat surface.

This patent specification further describes a waste toner collecting unit. In one non-limiting example, a waste toner collecting unit includes a container, a conveying device, and a detection unit. The container stores waste toner collected by and conveyed from two or more different external cleaning devices. The conveying device is provided in the container to horizontally convey the waste toner in the container and to press and up-thrust the waste toner after an amount of the waste toner reaches a predetermined value. The detection unit is provided above a position where the waste toner is pressed and up-thrust by the conveying device, and the detection unit is pressed and displaced by the pressed and up-thrust waste toner to be detected by an external sensor.

In one non-limiting example of the waste toner collecting unit, the container may include first and second fill ports. Additionally, more fill ports are possible. The first fill port may be provided on an upper surface of the container above one end of the conveying device to receive the waste toner from one of the two different external cleaning devices. The second fill port may be provided on the upper surface of the container above another end of the conveying device to receive the waste toner from the other of the two different external cleaning devices. The conveying device may include a screw member which rotates around an axis thereof to convey the waste toner put in the container through the first and second fill ports toward a center of the container. The screw member may include a first spiral member extending from one end to a center or central area of the screw member, and a second spiral member extending from the other end to the center or central area of the screw member. Additionally, the screw members may not extend all of the way to the center of the screw member. In some embodiments, the screw members are of different lengths. In other embodiments, the screw members are of approximately equal length. The detection unit may be located above a position where the waste toner conveyed by the first spiral member collides with the waste toner conveyed by the second spiral member.

In another non-limiting example of the waste toner collecting unit, the container may include first and second fill ports. Additionally, more fill ports are possible. The first fill port may be provided on an upper surface of the container above one end of the conveying device to receive the waste toner from one of the two different external cleaning devices. The second fill port may be provided on the upper surface of the container above another end of the conveying device to receive the waste toner from the other one of the two different external cleaning devices. However, other locations for the fill ports are possible. The conveying device may include a screw member which rotates around an axis thereof to convey the waste toner put in the container through the first and second fill ports toward a center of the container. The screw member may include a first spiral member extending from one end of the screw member to a center area of the screw member, and a second spiral member extending from the other end of the screw member to the center area of the screw member. The second spiral member may have a waste toner conveying ability substantially equal to that of the first spiral member. The detection unit may be arranged in the vicinity of one of the first and second fill ports and closer to the center of the container than the one of the first and second fill ports is.

In one non-limiting embodiment, the waste toner collecting unit, the first and second spiral members may have different lengths, and the detection unit may be arranged in vicinity of one of the first and second fill ports which is close to a shorter one of the first and second spiral members.

In another non-limiting embodiment, the waste toner collecting unit, the first and second spiral members may be substantially equal in length.

In one non-limiting example, the waste toner collecting unit, the detection unit may include a flexible seal and a movable member. The flexible seal may be provided on an upper surface of the container to be pressed and upwardly bent by the pressed and up-thrust waste toner. The movable member may have one end supported by an outer surface of the container and another end pressed and upwardly displaced by the upwardly bent flexible seal.

In the waste toner collecting unit, the container may include a leveling device provided in the container to level an upper surface of the waste toner in the container into a substantially flat surface.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
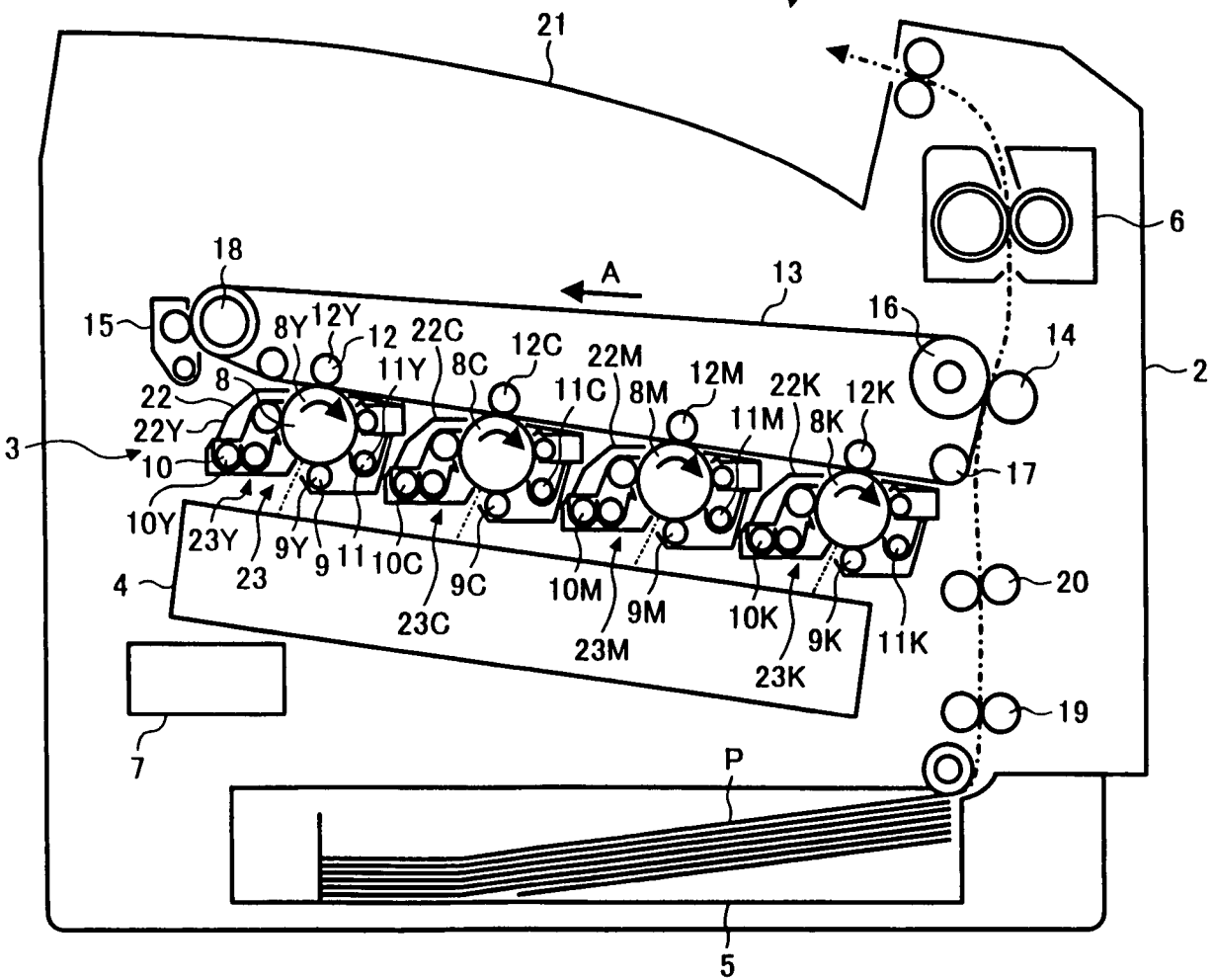
FIG. 1 is a schematic vertical sectional side view of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an image forming apparatus 1 according to an embodiment of the present invention is described.

FIG. 1 schematically illustrates a vertical sectional side view of the image forming apparatus 1, which is a color printer in this case. The image forming apparatus 1 of this non-limiting embodiment includes a housing 2, a printer engine 3, an optical writing device 4, a sheet-feeding cassette 5, a fixing device 6, a waste toner collecting unit 7, image carrying members 8Y, 8C, 8M, and 8K, charging rollers 9Y, 9C, 9M, and 9K, development devices 10Y, 10C, 10M, and 10K, image carrying member cleaning devices 11Y, 11C, 11M, and 11K, first transfer rollers 12Y, 12C, 12M, and 12K, an intermediate transfer belt 13, a second transfer roller 14, an intermediate transfer belt cleaning device 15, a drive roller 16, an entrance roller 17, a tension roller 18, a conveyance roller pair 19, a registration roller pair 20, a sheet ejection tray 21, unit cases 22Y, 22C, 22M, and 22K, and process cartridges 23Y, 23C, 23M, and 23K.

In the following description of components of the image forming apparatus 1, a component is referred to by a number without a suffix of Y, M, C or K in a description where the distinction of toner colors is not necessary, and is referred to by a number plus the suffix Y, M, C or K, where such distinction is necessary.

The printer engine 3 forms toner images and transfers the toner images to a recording medium P which is typically stored and sent out from the sheet-feeding cassette 5. The printer engine 3 typically includes the four image carrying members 8Y, 8C, 8M, and 8K, the charging rollers 9Y, 9C, 9M, and 9K, the development devices 10Y, 10C, 10M, and 10K, the image carrying member cleaning devices 11Y, 11C, 11M, and 11K, the first transfer rollers 12Y, 12C, 12M, and 12K, the intermediate transfer belt 13, the second transfer roller 14, and the intermediate transfer belt cleaning device 15.

The optical writing device 4 emits a light beam according to individual image data, and exposes an outer circumferential surface of a given image carrying member 8. The sheet-feeding cassette 5 stores sheets of the recording medium P to which toner images are transferred. The fixing device 6 fixes the toner images to the recording medium P, and the waste toner collecting unit 7 typically stores waste toner generated by a transfer operation of the toner images.

Each image carrying member 8 is a cylinder-shaped photoconductor in the present embodiment, and is driven by a drive motor (not illustrated) connected thereto to rotate around an axis of each image carrying member 8. Each image carrying member 8 is provided with a photosensitive layer on which an electrostatic latent image is formed. The outer circumferential surface of each image carrying member 8 is uniformly charged by an associated charging roller 9, and an electrostatic latent image is formed thereon.

Each charging roller 9 is in contact with the outer circumferential surface of each image carrying member 8, with or without a slight space between them. Each charging roller 9 is applied with a voltage by a power supply (not illustrated), so that corona discharge is generated between the charging roller 9 and the corresponding image carrying member 8. Accordingly, the outer circumferential surface of each image carrying member 8 is uniformly charged.

Each development device 10 supplies toner to a corresponding image carrying member 8. The toner thus supplied adheres to the electrostatic latent image formed on the outer circumferential surface of each image carrying member 8. As a result, the electrostatic latent image is developed into a visible toner image.

In this particular embodiment, the intermediate transfer belt 13 is a loop-shaped belt, a base substance of which is a resin film or rubber. The intermediate transfer belt 13 passes over the drive roller 16, the entrance roller 17, and the tension roller 18. As the drive roller 16 is driven to rotate by a drive motor (not illustrated) connected thereto, the intermediate transfer belt 13 rotates in a direction indicated by an arrow "A" shown in FIG. 1. Along with rotation of the intermediate transfer belt 13, the entrance roller 17 and the tension roller 18 are driven by frictional force between each of the entrance roller 17 and the tension roller 18 and the intermediate transfer belt 13.

The first transfer roller 12 is provided at an inner circumferential surface (i.e., the inside surface) of the of the intermediate transfer belt 13. As the first transfer roller 12 is applied with a transfer voltage, the toner image formed on the image carrying member 8 is transferred to the intermediate transfer belt 13. The toner images formed on the respective image carrying members 8Y, 8C, 8M, and 8K are sequentially transferred to and superimposed on the intermediate transfer belt 13. Accordingly, a color toner image is formed on the intermediate transfer belt 13.

An image carrying member cleaning device 11 is provided to clean the outer circumferential surface of each corresponding image carrying member 8 after a toner image is transferred from the corresponding image carrying member 8 to the intermediate transfer belt 13. In this cleaning operation, toner and paper powders remaining on the outer circumferential surface of the corresponding image carrying member 8 after the toner image has been transferred to the intermediate transfer belt 13 are collected as waste toner.

The second transfer roller 14 is applied with a transfer voltage when the recording medium P is moved to a transfer position where the intermediate transfer belt 13 contacts the second transfer roller 14. Accordingly, the color toner image formed on the intermediate transfer belt 13 is transferred to the recording medium P.

The recording medium P is sent out from the sheet-feeding cassette 5 and conveyed by the conveyance roller pair 19 and the registration roller pair 20. After the toner image is transferred to the recording medium P, the recording medium P is subjected to a fixing operation by the fixing device 6. The recording medium P is applied with heat and pressure in the fixing device 6, and toner in the toner image is fused and fixed on the recording medium P. After this fixing operation, the recording medium P is ejected to the sheet ejection tray 21 provided on an upper surface of the housing 2 of the image forming apparatus 1.

The intermediate transfer belt cleaning device 15 cleans an outer circumferential surface of the intermediate transfer belt 13 after the color toner image has been transferred to the recording medium P. In this cleaning operation, toner and paper powders remaining on the outer circumferential surface of the intermediate transfer belt 13 after the toner image has been transferred to the recording medium P are collected as waste toner.

The waste toner collecting unit 7 stores the waste toner collected by and conveyed from the image carrying member cleaning device 11 and the intermediate transfer belt cleaning device 15. The waste toner collecting unit 7 is detachably attached to the housing 2. When the waste toner collecting unit is filled or nearly filled with the waste toner, the waste toner collecting unit 7 is typically detached from the housing 2 and replaced by a new unfilled waste toner collecting unit 7.

In one non-limiting example, each image carrying member 8, each charging roller 9, each development device 10, and each image carrying member cleaning device 11, which form the printer engine 3, are typically integrally stored in a corresponding case 22 and form each process cartridge 23. Each process cartridge 23 is detachably attached to the housing 2. With the corresponding image carrying member 8, the corresponding charging roller 9, the corresponding development device 10, and the corresponding image carrying member cleaning device 11 integrally stored in each process cartridge 23, replacement and maintenance of these components can be facilitated. Further, position accuracy between the components can be well maintained. Accordingly, quality of images formed by the image forming apparatus 1 can be improved. Each process cartridge 23 according to the present embodiment includes the corresponding image carrying member 8, the corresponding charging roller 9, the corresponding development device 10, and the corresponding image carrying member cleaning device 11, as one example. Alternatively, each process cartridge 23 may be differently configured. For example, each process cartridge 23 may include the corresponding image carrying member 8 and at least one of the corresponding charging roller 9, the corresponding development device 10, and the corresponding image carrying member cleaning device 11.

Figure 2:
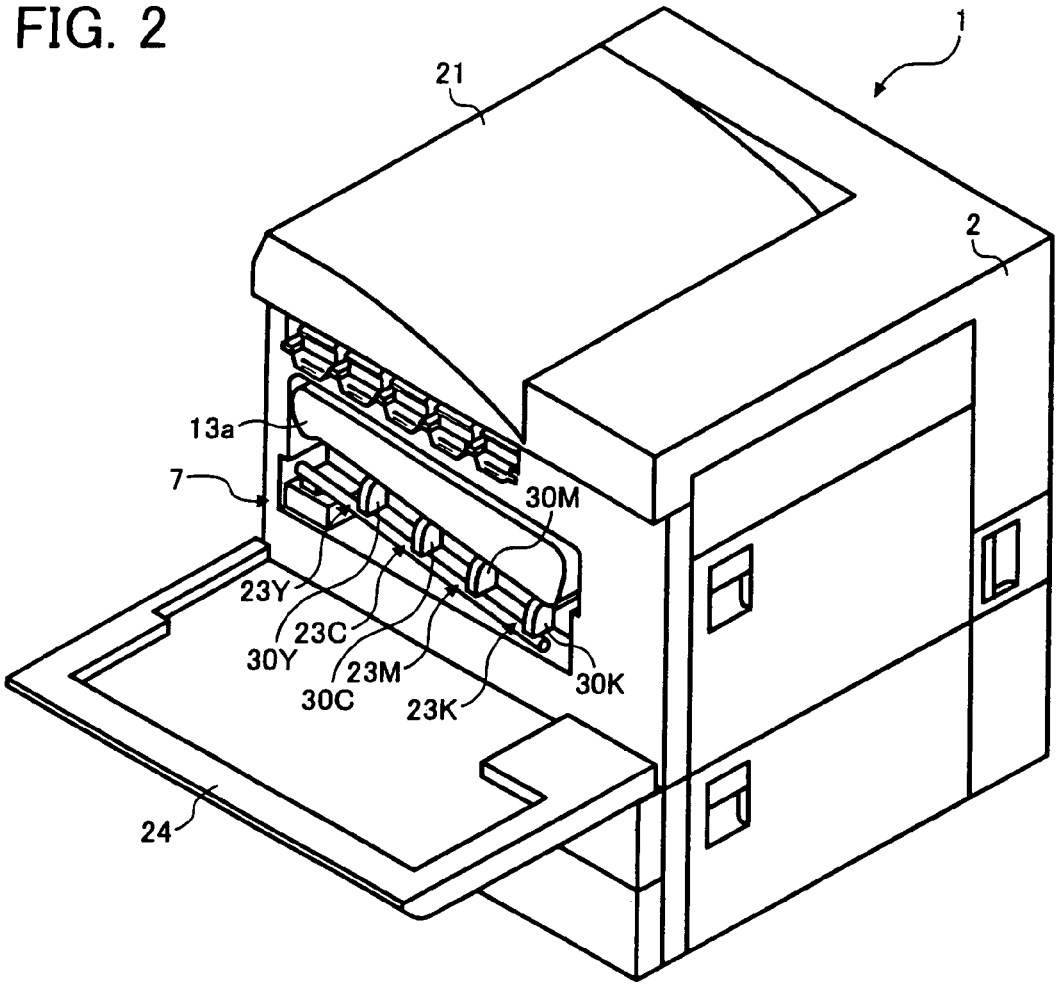
FIG. 2 is a perspective view of the image forming apparatus shown in FIG. 1 with a side cover opened.

FIG. 2 illustrates a perspective view of the image forming apparatus 1, wherein a side cover 24 provided on the housing 2 is opened. In FIG. 2, 13*a* indicates a belt case, and 30Y, 30C, 30M, and 30K indicate waste toner discharge parts of the respective image carrying member cleaning devices 11Y, 11C, 11M, and 11K. The belt case 13*a* includes the intermediate transfer belt 13, the drive roller 16, the entrance roller 17, and the tension roller 18.

When the side cover 24 is opened, the printer engine 3 and the waste toner collecting unit 7 are revealed so that replacement and maintenance of such components as each process cartridge 23, the intermediate transfer belt 13, and the waste toner collecting unit 7 can be carried out.

Figure 3:
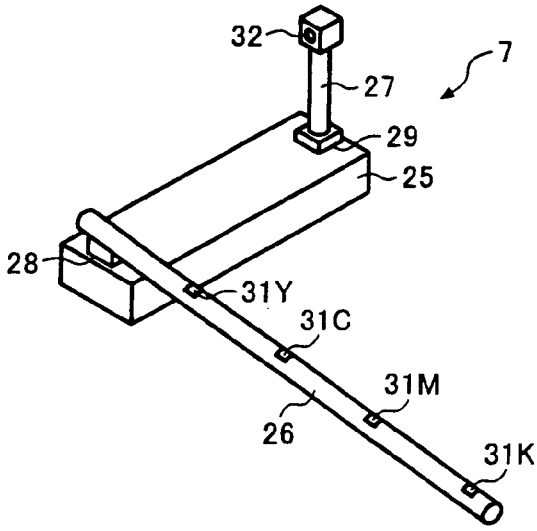
FIG. 3 is a perspective view of a waste toner collecting unit.

FIG. 3 illustrates a perspective view of the one example of the waste toner collecting unit 7. The waste toner collecting unit 7 includes a container 25, waste toner conveying pipes 26 and 27, fill ports 28 and 29, connection holes 31Y, 31C, 31M, 31K, and 32.

In this non-limiting embodiment, the container 25 is a hollow rectangle, extending along a direction in which the waste toner collecting unit 7 is attached to or detached from the housing 2. However, other shapes of the container 25 are possible. The fill ports 28 and 29 are provided on an upper surface of the container 25, with the fill port 28 at one of two ends of the container 25 in a longitudinal direction of the container 25, and the fill port 29 at the other one of two ends of the container 25 in the longitudinal direction of the container 25. Of course, the fill ports 28 and 29 can be in other locations instead of or in addition to being on the upper surface of the container 25. Additionally, more than two fill ports may be used. The waste toner conveying pipes 26 and 27 are connected to the fill ports 28 and 29, respectively. The waste toner conveying pipe 26 conveys the waste toner collected by the image carrying member cleaning devices 11Y, 11C, 11M, and 11K, which clean the image carrying members 8Y, 8C, 8M, and 8K, into the container 25. The waste toner conveying pipe 26 is provided with the four connection holes 31Y, 31C, 31M, and 31K which are connected to the toner discharge parts 30Y, 30C, 30M, and 30K (illustrated in FIG. 2) of the image carrying member cleaning devices 11Y, 11C, 11M, and 11K. The waste toner conveying pipe 26 includes a conveying screw (not illustrated) which conveys the waste toner discharged from the image carrying member cleaning device 11 to the fill port 28. Meanwhile, the other waste toner conveying pipe 27 conveys the waste toner collected from the intermediate transfer belt cleaning device 15 into the container 25. The waste toner conveying pipe 27 is provided with the connection hole 32 which is connected to a toner discharge part (not illustrated) of the intermediate transfer belt cleaning device 15. The waste toner conveying pipe 27 includes a conveying screw (not illustrated) which conveys the waste toner discharged from the intermediate transfer belt cleaning device 15 to the fill port 29.

Figure 4:
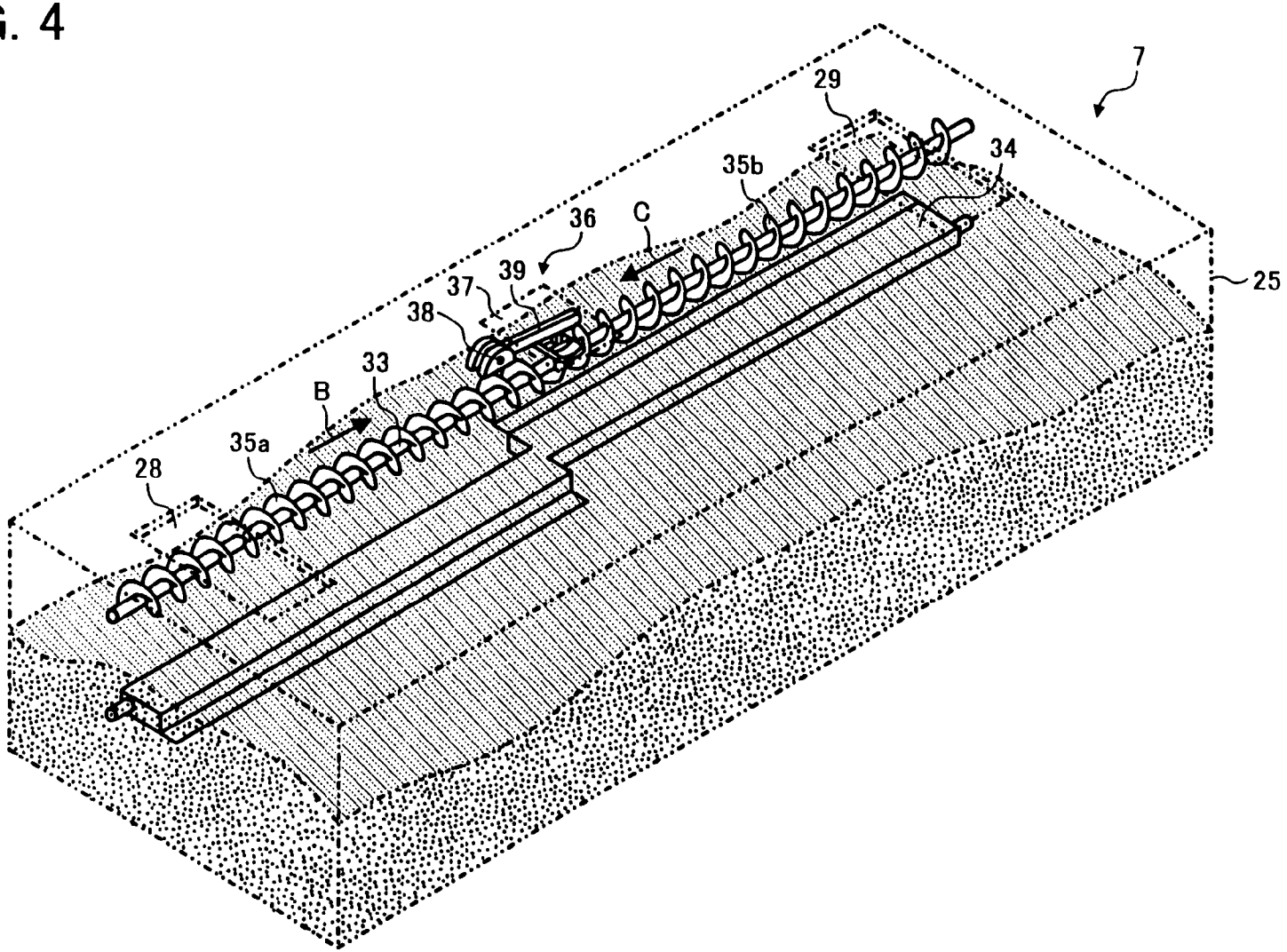
FIG. 4 is a perspective view of a container of the waste toner collecting unit shown in FIG. 3.

FIG. 4 illustrates a perspective view of the container 25 of the waste toner collecting unit 7. As described with reference to FIG. 3, the two fill ports 28 and 29 are formed on the upper surface of the container 25 at two ends in the longitudinal direction of the container 25, and connected to the waste toner conveying pipes 26 and 27, respectively. The container 25 is typically provided with a conveying screw 33, an agitator 34, conveying spiral members 35*a* and 35*b*, a spindle 38, and a detection unit 36 which includes a flexible seal 37 and a movable portion 39. The waste toner is indicated by hatching in FIGS. 4 to 7.

The conveying screw 33 which conveys the waste toner and the agitator 34 which levels the waste toner are provided in the container 25 to extend in the longitudinal direction of the container 25 (i.e., a direction of piercing the two fill ports 28 and 29) and to be rotatable around axes thereof. The conveying screw 33 is located in an upper part of the container 25 and above the agitator 34. When the waste toner collecting unit 7 is attached to the housing 2, the conveying screw 33 and the agitator 34 are connected to a drive motor (not illustrated) which is provided in the housing 2, and are driven by a drive force of the drive motor.

The conveying screw 33 is provided with the conveying spiral members 35*a* and 35*b*. In this non-limiting example, the conveying spiral member 35*a* typically extends approximately from one end of the conveying screw 33 towards the center of the conveying screw 33, while the conveying spiral member 35*b* typically extends from the other end of the conveying screw 33 towards the center of the conveying screw 33. As the conveying screw 33 is driven to rotate by a drive motor (not illustrated), the conveying spiral member 35*a* conveys the waste toner put in the container 25 through the fill port 28 from one end of the container 25 (i.e., the one end of the conveying screw 33) toward the center of the container 25, while the conveying spiral member 35*b* conveys the waste toner put in the container 25 through the fill port 29 from the other end of the container 25 (i.e., the other end of the conveying screw 33).

Therefore, the waste toner conveyed through the fill ports 28 and 29 into the container 25 is accumulated in the container 25 up to a level of contacting the conveying screw 33, and then horizontally conveyed from both ends of the conveying screw 33 toward the center of the conveying screw 33 as indicated by arrows "B" and "C" shown in FIG. 4. Further, after an amount of the waste toner in the container 25 has reached a predetermined value, the waste toner is conveyed by the conveying spiral members 35*a* and 35*b*, as the conveying screw 33 rotates. Waste toner conveyed by the conveying spiral member 35*a* typically collides with waste toner conveyed by the conveying spiral member 35*b*, and there arises an up-thrust of the waste toner. The two conveying spiral members 35*a* and 35*b* may be equal in diameter, pitch of their spiral portions, length, and waste toner conveying ability. However, in other embodiments, the spirals may have different diameters, pitches, lengths etc.

The agitator 34 rotates around its axis to stir the waste toner put in the container 25 and levels the waste toner so that an upper surface of the waste toner in the container 25 becomes substantially flat.

On the upper surface of the container 25, the detection unit 36 is provided to detect the up-thrust of the waste toner generated by the collision of the waste toner conveyed by the conveying spiral member 35*a* and the waste toner conveyed by the conveying spiral member 35*b*. That is, the detection unit 36 is used to detect that the container 25 is filled or nearly filled with the waste toner. The flexible seal 37 is pressed by the up-thrust waste toner and upwardly bent. The flexible seal 37 may be made of a silicon rubber, for example. The movable portion 39 has an end rotatably supported by the spindle 38, and the other end pressed and upwardly displaced by the upwardly bent flexible seal 37.

Figure 5:
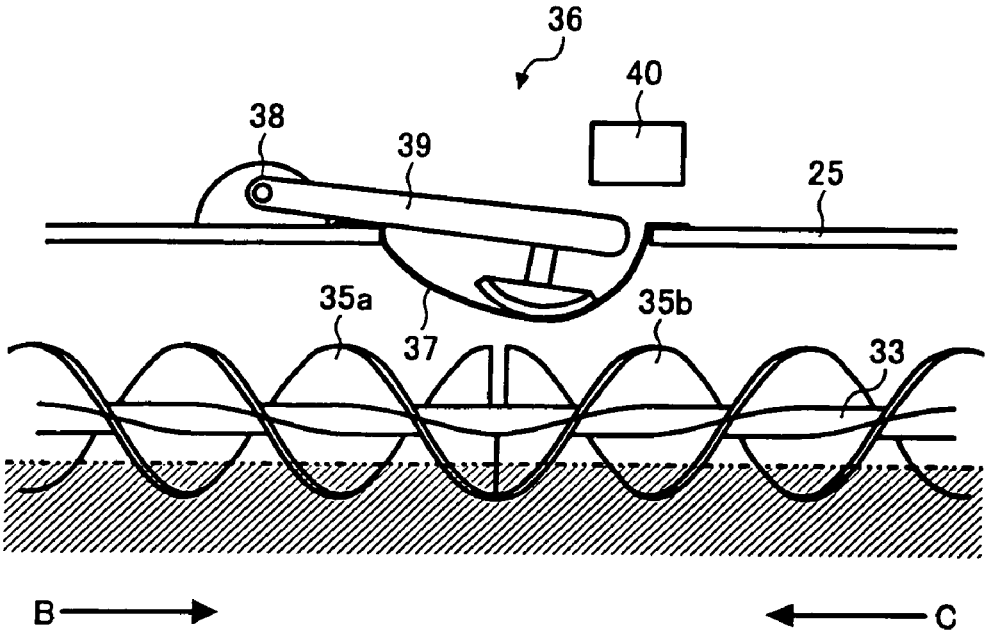
FIG. 5 is a vertical sectional front view of the container of the waste toner collecting unit, in which waste toner is stored up to a level reaching a conveying screw and horizontally conveyed by the conveying screw.
Figure 6:
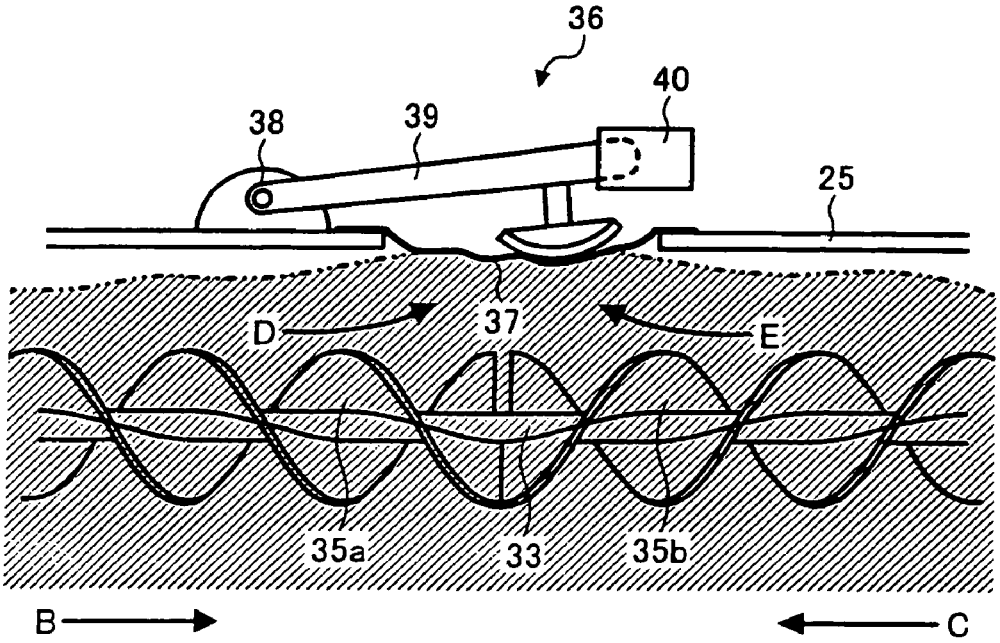
FIG. 6 is another vertical sectional front view of the container of the waste toner collecting unit, in which the waste toner conveyed by the conveying screw is pressed and up-thrust.

As illustrated in FIGS. 5 and 6, the housing 2 may be provided with a photointerrupter 40, which serves as a sensor for detecting the other end of the movable portion 39 included in the waste toner collecting unit 7. The photointerrupter 40 detects the other end of the movable portion 39 when the other end of the movable portion 39 moves upward. Of course, other types of sensors may be used instead of the photointerrupter 40. By way of non-limiting example, inductive or capacitive proximity sensors may replace or supplement the photointerrupter 40.

With the image forming apparatus 1 thus configured, when an image forming operation starts, toner images are formed on the image carrying members 8Y, 8C, 8M, and 8K and sequentially transferred to the intermediate transfer belt 13. Accordingly, a color toner image is formed on the intermediate transfer belt 13. The color toner image formed on the intermediate transfer belt 13 is then transferred to the recording medium P by the second transfer roller 14. The recording medium P to which the color toner image has been transferred is subjected to the fixing operation in the fixing device 6 and ejected to the sheet ejection tray 21.

In this example of the image forming operation, toner remaining on the image carrying members 8Y, 8C, 8M, and 8K is collected as waste toner by the image carrying member cleaning devices 11Y, 11C, 11M, and 11K, respectively, and toner remaining on the intermediate transfer belt 13 is collected as waste toner by the intermediate transfer belt cleaning device 15.

As illustrated in FIG. 3, the waste toner collected by the image carrying member cleaning device 11 is typically conveyed to the container 25 through the waste toner conveying pipe 26 and the fill port 28. Meanwhile, the waste toner collected by the intermediate transfer belt cleaning device 15 is conveyed to the container 25 through the waste toner conveying pipe 27 and the fill port 29. That is, the waste toner collected by the image carrying member cleaning device 11 and the waste toner collected by the intermediate transfer belt cleaning device 15 are separately conveyed to the fill ports 28 and 29, respectively, through the respective waste toner conveying pipes 26 and 27. Therefore, there is no need to merge the waste toner collected by the image carrying member cleaning device 11 with the waste toner collected by the intermediate transfer belt cleaning device 15 and convey the merged waste toner to the container 25. As a result, pipe arrangement for conveying the waste toner to the container 25 can be simplified. Further, deflections in waste toner conveying pipes can be reduced, and blockage of the waste toner in the pipes can be prevented.

The waste toner conveyed into the container 25 through the fill ports 28 and 29 is typically stirred and horizontally leveled by the agitator 34 as the agitator 34 rotates. Therefore, the container 25 can store the waste toner conveyed thereto while keeping the upper surface of the waste toner substantially flat. Accordingly, a waste toner filling rate of the container 25 can be increased.

FIG. 5 illustrates a vertical sectional front view of the container 25, wherein the waste toner is stored up to a level of contacting the conveying screw 33 and horizontally conveyed by the conveying screw 33.

As described above, the conveying screw 33 is provided with the conveying spiral members 35*a* and 35*b* such that the conveying spiral member 35*a* may extend from one end to the center (or some other central area) of the conveying screw 33 and the conveying spiral member 35*b* extends from the other end to the center (or some other central area) of the conveying screw 33. Therefore, the waste toner put in the container 25 through the fill port 28 is conveyed toward the center (or other interior portion) of the container 25 in the direction as indicated by the arrow "B," while the waste toner put in the container 25 through the fill port 29 is conveyed toward the center of the container 25 in the direction as indicated by the arrow "C." In the waste toner conveying operation by the conveying screw 33, as the agitator 34 rotates, the waste toner is also spread in directions perpendicular to the directions indicated by the arrows "B" and "C." Accordingly, the upper surface of the waste toner is kept substantially flat. In this state, the flexible seal 37 is not in contact with the waste toner in the container 25, and thus the flexible seal 37 is downwardly bent. Therefore, the movable portion 39 stays at a relatively low level and is not detected by the photointerrupter 40.

FIG. 6 illustrates a vertical sectional front view of the container 25, wherein the waste toner conveyed by the conveying spiral member 35*a* collides with the waste toner conveyed by the conveying spiral member 35*b* and there arises an up-thrust of waste toner.

If the container 25 continues to receive the waste toner through the fill ports 28 and 29 after the conveying screw 33 starts horizontally conveying the waste toner, the waste toner conveyed by the conveying spiral member 35*a* and the waste toner conveyed by the conveying spiral member 35*b* collide with each other and are pressed and up-thrust in directions indicated by arrows "D" and "E" shown in FIG. 6 at a position where the conveying spiral member 35*a* faces the conveying spiral member 35*b*.

The detection unit 36 including the flexible seal 37 and the movable portion 39 is provided above the position where the waste toner is up-thrust. Therefore, the up-thrust waste toner upwardly presses and bends the flexible seal 37, and the upwardly bent flexible seal 37 presses the movable portion 39. As a result, the movable portion 39 moves upward, with the spindle 38 serving as a fulcrum. When the movable portion 39 moves up to a predetermined position, the movable portion 39 is detected by the photointerrupter 40. That is, it is detected that the container 25 is filled or nearly filled with the waste toner.

A result of the detection by the photointerrupter 40 may be displayed on a display screen on an operation panel (not illustrated) of the image forming apparatus 1. By checking the display screen, a user of the image forming apparatus 1 can timely open the side cover 24 to replace the waste toner collecting unit 7 with a new one. Of course, instead of, or in addition to displaying the detection signal on a display screen, other indications that the container 25 is full may be produced.

Figure 7:
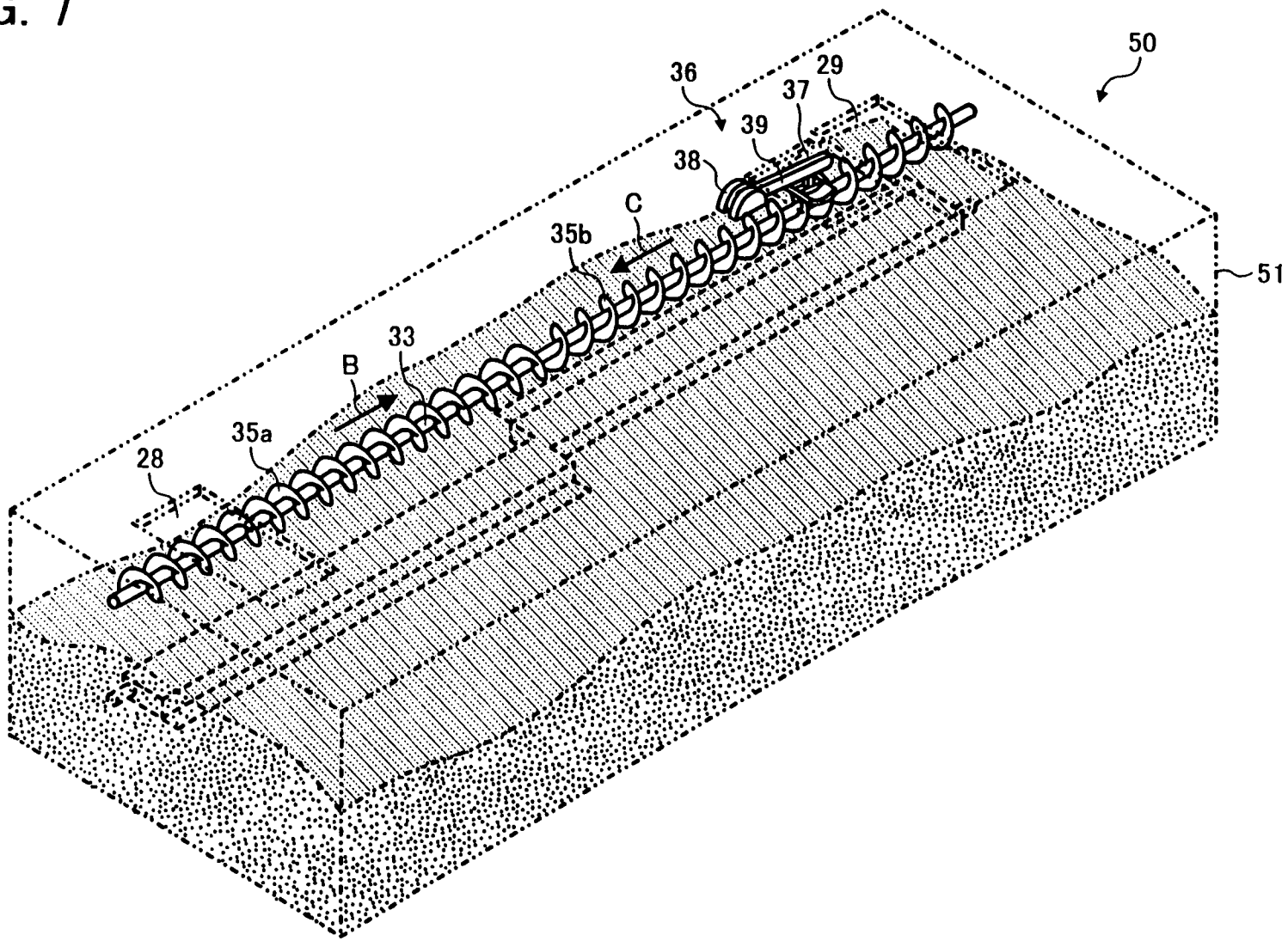
FIG. 7 is a perspective view of a container of a waste toner collecting unit according to another embodiment of the present invention.
Figure 8:
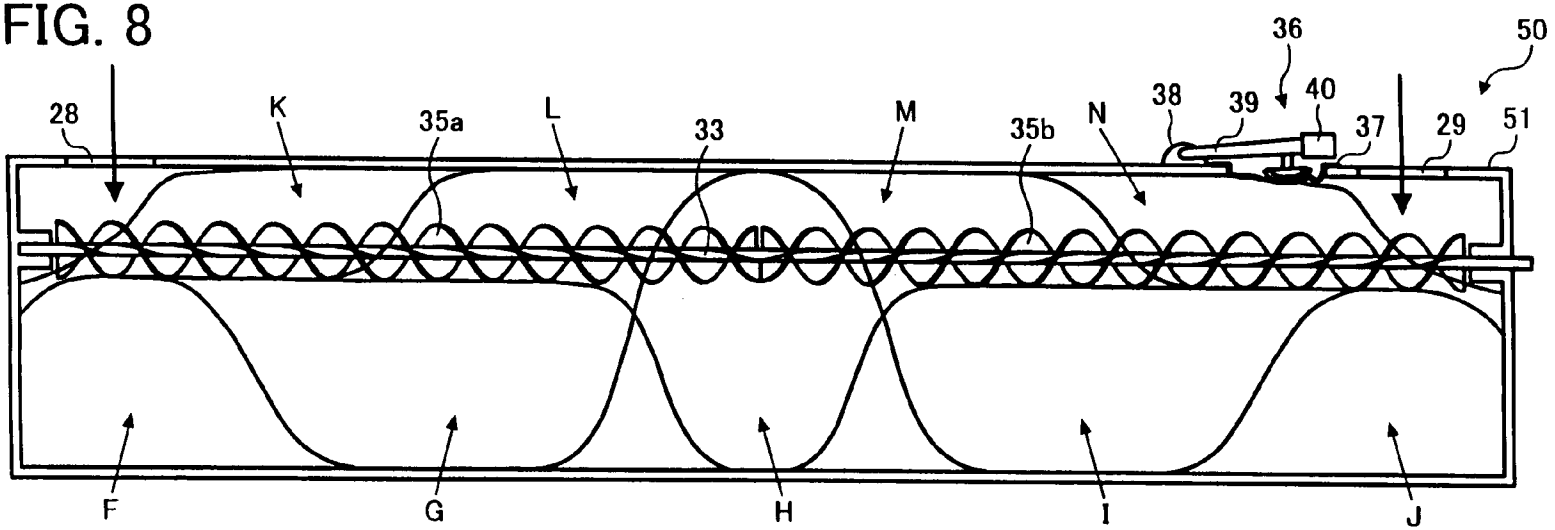
FIG. 8 is a vertical sectional front view of the container of the waste toner collecting unit shown in FIG. 7, illustrating a process of waste toner accumulation in the container and detection of a detection unit.

With reference to FIGS. 7 and 8, a waste toner collecting unit according to another embodiment of the present invention is described.

Description is omitted for components shown in FIG. 7 which are also components shown in FIG. 4, and differences between the waste toner collecting unit 7 in FIG. 4 and the waste toner collecting unit 50 of FIG. 7 are described.

The waste toner collecting unit 50 shown in FIG. 7 is different from the waste toner collecting unit 7 shown in FIG. 4 in the position where the detection unit 36 is provided. With this change in position of the detection unit 36, the photointerrupter 40 is also changed in position. A container 51 shown in FIG. 7 corresponds to the container 25 shown in FIG. 4.

FIG. 7 illustrates a perspective view of the container 51 of the waste toner collecting unit 50. In this non-limiting embodiment, the container 51 is a hollow rectangle, extending along the direction in which the waste toner collecting unit 50 is attached to or detached from the housing 2. Of course, other shapes for the container 51 may be used. As described above with reference to FIG. 3, the two fill ports 28 and 29 are formed on the upper surface of the container 51 at the two ends of the container 51 in the longitudinal direction of the container 51, and the fill ports 28 and 29 are connected to the waste toner conveying pipes 26 and 27, respectively.

The conveying screw 33 is provided in the container 51 to extend in the longitudinal direction of the container 51 (i.e., the direction of piercing the two fill ports 28 and 29) and to be rotatable around an axis thereof. When the waste toner collecting unit 50 is attached to the housing 2, the conveying screw 33 is connected to a drive motor (not illustrated) which is provided in the housing 2, and is driven by a drive force of the drive motor. The conveying spiral members 35*a* and 35*b* are equal in diameter, pitch of their spiral portions, length, and waste toner conveying ability.

On the upper surface of the container 51, the detection unit 36 is provided to detect the up-thrust of the waste toner generated by the collision of the waste toner conveyed by the conveying spiral member 35*a* and the waste toner conveyed by the conveying spiral member 35*b* after the waste toner in the container 51 has reached the predetermined amount. As described above, the detection unit 36 includes the flexible seal 37 and the movable portion 39. The detection unit 36 is provided at a position in the vicinity of the fill port 29 and closer to the center of the container 51 than is the fill port 29.

With reference to FIG. 8, description is made on conveyance of the waste toner to the container 51 and detection of the waste toner stored in the container 51 by using the detection unit 36.

In an area F, the waste toner put in the container 51 through the fill port 28 is accumulated in a pile in the container 51. Similarly, in an area J, the waste toner put in the container 51 through the fill port 29 is accumulated in a pile in the container 51.

In an area G, the waste toner accumulated in a pile in the container 51 spreads toward the center of the container 51. When the conveying spiral member 35*a* attached to the conveying screw 33 contacts the pile of waste toner, an upper portion of the pile of waste toner falls off due to rotation of the conveying spiral member 35*a* and spreads towards the center of the container 51. Similarly, in an area I, the waste toner accumulated in a pile in the container 51 spreads toward the center of the container 51. When the conveying spiral member 35*b* attached to the conveying screw 33 contacts the pile of waste toner, an upper portion of the pile of waste toner falls off due to rotation of the conveying spiral member 35*b* and spreads towards the center of the container 51.

In an area H, the waste toner spread from the area G toward the center of the container 51 and the waste toner spread from the area I toward the center of the container 51 collide with each other at the center of the container 51, and there arises an up-thrust of waste toner.

If waste toner continues to be put into the container 51 after the up-thrust of waste toner is generated in the area H, the waste toner is conveyed by either one of the conveying spiral members 35*a* and 35*b* toward the area H. Then, the waste toner is gradually spread towards both sides of the container 51 (i.e., both sides of the conveying screw 33) first into areas L and M and then to areas K and N.

When the up-thrust waste toner is spread into the areas K and N towards the fill ports 28 and 29, the waste toner thus spread presses the flexible seal 37 of the detection unit 36 to be upwardly bent. The upwardly bent flexible seal 37 presses the movable portion 39, and the movable portion 39 moves upward with the spindle 38 serving as a fulcrum. When the movable portion 39 moves up to a predetermined position, the movable portion 39 is detected by the photointerrupter 40 (or other sensor as discussed above). That is, it is detected that the container 51 is filled or nearly filled with the waste toner.

A result of the detection by the photointerrupter 40 is displayed on the display screen of the operation panel (not illustrated) of the image forming apparatus 1. By checking the display screen, the user of the image forming apparatus 1 can timely open the side cover 24 to replace the waste toner collecting unit 51 with a new one. Of course, other indications that the photointerrupter 40 has been triggered may be given instead of or in addition to displaying a signal on a display screen.

In this non-limiting embodiment, in the areas H, K, L, M, and N of the container 51 where the waste toner is conveyed and up-thrust by the conveying spiral members 35*a* and 35*b*, the waste toner is spread substantially evenly towards the both ends of the conveying screw 33 from a position at which the conveying spiral members 35*a* and 35*b* face each other. When the up-thrust waste toner is spread to the vicinity of the fill ports 28 and 29, therefore, the displacement of the movable portion 39 can be detected by the photointerrupter 40. Accordingly, the waste toner filling rate of the container 51 can be increased.

The conveying spiral members 35*a* and 35*b* may be configured to have equal waste toner conveying ability. Therefore, even if the waste toner put in the container 51 through the fill port 28 is different in amount from the waste toner put in the container 51 through the fill port 29, the waste toner conveyed and up-thrust by the conveying spiral members 35*a* and 35*b* spreads substantially evenly toward the both ends of the conveying screw 33 from the position at which the conveying spiral members 35*a* and 35*b* face with each other. Accordingly, the waste toner filling rate of the container 51 can be increased.

According to the mechanism as described above, even if a relatively large amount of waste toner is conveyed from a side of the conveying spiral member 35*a* to a side of the conveying spiral member 35*b*, for example, the waste toner is conveyed back toward the conveying spiral member 35*a* by the conveying spiral member 35*b*. Therefore, the waste toner is prevented from being conveyed in a particular direction (i.e., from the side of the conveying spiral member 35*a* to the side of the conveying spiral member 35*b* in this case).

Figure 9:
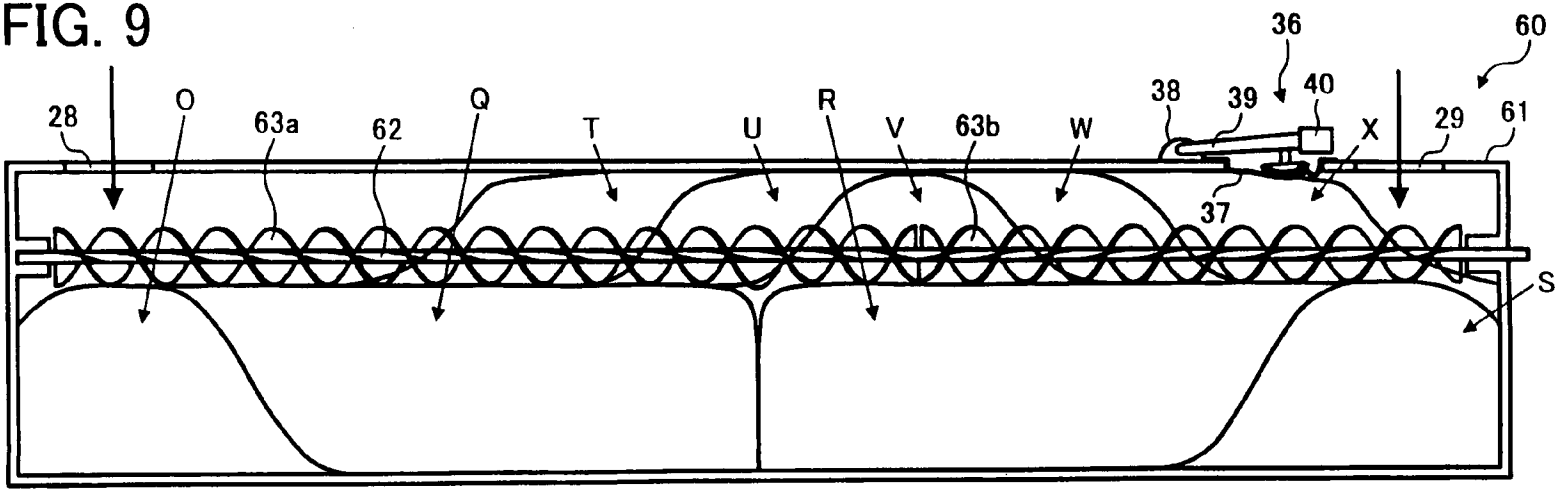
FIG. 9 is a vertical sectional front view of a container of a waste toner collecting unit according to still another embodiment of the present invention, illustrating a process of waste toner accumulation in the container and detection of a detection unit.

With reference to FIG. 9, a waste toner collecting unit according to still another embodiment of the present invention is described. FIG. 9 is a vertical sectional front view of a container 61 in the waste toner collecting unit 61, illustrating conveyance of the waste toner to the container 61 and detection of the waste toner stored in the container 61 by using the detection unit 36.

Description is omitted for components shown in FIG. 9 which are also components shown in FIG. 8, and differences between the waste toner collecting unit 50 of FIG. 8 and the waste toner collecting unit 60 of FIG. 9 are described.

In the waste toner collecting unit 60 of FIG. 9, a container 61, a conveying screw 62, and the conveying spiral members 63*a* and 63*b* are provided in replacement of the container 51, the conveying screw 33, and the conveying spiral members 35*a* and 35*b* of the waste toner collecting unit 50 of FIG. 8.

The container 61 is shown as a hollow rectangle extending along the direction in which the waste toner collecting unit 60 is attached to or detached from the housing 2. As discussed above, other shapes for the container are possible. As described above with reference to FIG. 3, the two fill ports 28 and 29 may be formed on the upper surface of the container 61 at the two ends of the container 61 in the longitudinal direction of the container 61, and the fill ports 28 and 29 are connected to the waste toner conveying pipes 26 and 27, respectively. However, other locations of the fill ports 28 and 29 are possible.

The conveying screw 62 is provided in the container 61 to extend in the longitudinal direction of the container 61 (i.e., the direction of piercing the two fill ports 28 and 29) and to be rotatable around an axis thereof. When the waste toner collecting unit 60 is attached to the housing 2, the conveying screw 62 is connected to a drive motor (not illustrated) provided in the housing 2 and driven by a drive force of the drive motor. The conveying screw 62 is provided with the conveying spiral members 63*a* and 63*b*. The conveying spiral members 63*a* and 63*b* may be equal in diameter, pitch of their spiral portions, and waste toner conveying ability. However, in this particular embodiment, the conveying spiral members 63*a* and 63*b* are different in length, with the conveying spiral member 63*b* made shorter than the conveying spiral member 63*a*.

On the upper surface of the container 61, the detection unit 36 is provided to detect the up-thrust of waste toner generated by the collision of the waste toner conveyed by the conveying spiral member 63*a* attached to the conveying screw 62 and the waste toner conveyed by the conveying spiral member 63*b* attached to the conveying screw 62 after the waste toner in the container 61 has reached a predetermined amount. As described above, the detection unit 36 includes the flexible seal 37 and the movable portion 39. The detection unit 36 is provided at a position which is in the vicinity of the fill port 29 provided at a side of the conveying spiral member 63*b* of a shorter length, and which is closer to the center of the container 61 than the fill port 29 is.

In an area O of the thus configured waste toner collecting unit 60 shown in FIG. 9, the waste toner put in the container 61 through the fill port 28 is accumulated in a pile in the container 61. Similarly, in an area S, the waste toner put in the container 61 through the fill port 29 is accumulated in a pile in the container 61.

In an area Q, the waste toner accumulated in a pile in the container 61 spreads toward the center of the container 61. When the conveying spiral member 63*a* attached to the conveying screw 62 contacts the pile of waste toner, an upper portion of the pile of waste toner falls off due to rotation of the conveying spiral member 63*a* and spreads towards the center of the container 61. Similarly, in an area R, the waste toner accumulated in a pile spreads toward the center of the container 61. When the conveying spiral member 63*b* attached to the conveying screw 62 contacts the pile of waste toner, an upper portion of the pile of waste toner falls off due to rotation of the conveying spiral member 63*b* and spreads towards the center of the container 61.

In an area V, the waste toner spread from the area Q toward the center of the container 61 and the waste toner spread from the area R toward the center of the container 61 collide with each other at a position at which the conveying spiral member 63*a* faces the conveying spiral member 63*b*, and there arises an up-thrust of waste toner.

If waste toner continues to be put into the container 61 after the up-thrust of waste toner is generated in the area V, the waste toner is conveyed by the conveying spiral members 63*a* and 63*b* toward the area V. Then, the waste toner is gradually spread towards both sides of the container 61 (i.e., both sides of the conveying screw 62) first into areas U and W and then to areas T and X.

When the up-thrust waste toner is spread into the area X towards the fill port 29, the waste toner thus spread presses the flexible seal 37 of the detection unit 36 to be upwardly bent. The upwardly bent flexible seal 37 presses the movable portion 39, and the movable portion 39 moves upward, with the spindle 38 serving as a fulcrum. When the movable portion 39 moves up to a predetermined position, the movable portion 39 is detected by the photointerrupter 40. That is, it is detected that the container 61 is filled or nearly filled with the waste toner.

A result of the detection by the photointerrupter 40 is displayed on the display screen of the operation panel (not illustrated) of the image forming apparatus 1. By checking the display screen, the user of the image forming apparatus 1 can timely open the side cover 24 to replace the waste toner collecting unit 61 with a new one.

When the photointerrupter 40 detects the detection unit 36 in this case, a distance between the area T and the fill port 28 is greater than a distance between the area X and the fill port 29. Therefore, the waste toner in the area X reaches the detection unit 36 before the waste toner in the area T reaches the fill port 28. Accordingly, it is detected with relatively high accuracy that the waste toner in the container 61 is filled or nearly filled with the waste toner, before the waste toner leaks out of the container 61 from the fill port 28. As a result, the waste toner can be safely prevented from leaking out of the container 61 from the fill ports 28 and 29.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an image carrying member configured to rotate and carry a toner image thereon;

a transfer device configured to transfer the toner image to a recording medium;

a first cleaning device configured to collect toner remaining on the image carrying member as waste toner after a primary transfer operation of the toner image from the image carrying member to the transfer device;

a second cleaning device configured to collect toner remaining in the transfer device as waste toner after a secondary transfer operation of the toner image from the transfer device to the recording medium; and a waste toner collecting unit configured to store the waste toner, comprising:

a container configured to store the waste toner collected by and conveyed from the first and second cleaning devices;

a conveying device provided in the container, and configured to horizontally convey the waste toner in the container, and to press and up-thrust the waste toner after an amount of the waste toner reaches a predetermined value; and a detection unit provided above a position where the waste toner is pressed and up-thrust by the conveying device, and configured to be pressed and displaced by the pressed and up-thrust waste toner, and to be detected by a sensor.

2. The image forming apparatus as described in claim 1, further comprising:

a process cartridge detachably provided in the image forming apparatus, and configured to store the image carrying member, and at least one of the first cleaning device, a charging device, and a development device, wherein the charging device and the development device are configured to form the toner image on the image carrying member according to an electrostatic photography method, and wherein the image carrying member includes a photoconductor.

3. The image forming apparatus as described in claim 1, wherein the container comprises:

a first fill port provided on the container and configured to receive the waste toner from one of the first and second cleaning devices; and a second fill port provided on the container and configured to receive the waste toner from the other of the first and second cleaning devices, wherein the conveying device comprises a screw member configured to rotate around an axis thereof to convey the waste toner in the container toward a center of the container, the screw member comprising a first spiral member extending from one end of the screw member toward a center of the screw member; and a second spiral member extending from the other end of the screw member toward the center of the screw member, and wherein the detection unit is located above a position where the waste toner conveyed by the first spiral member collides with the waste toner conveyed by the second spiral member.

4. The image forming apparatus as described in claim 3, wherein the first and second ports are provided on an upper surface of the container and at opposite ends of the conveying device.

5. The image forming apparatus as described in claim 1, wherein the container comprises:

a first fill port provided on the container and configured to receive the waste toner from one of the first and second cleaning devices; and a second fill port provided on the container and configured to receive the waste toner from the other of the first and second cleaning devices, wherein the conveying device comprises a screw member configured to rotate around an axis thereof to convey the waste toner in the container toward a center of the container, the screw member comprising a first spiral member extending from one end of the screw member toward a center of the screw member; and a second spiral member extending from the other end of the screw member toward the center of the screw member, and having a waste toner conveying ability substantially equal to that of the first spiral member, and wherein the detection unit is arranged in close proximity to one of the first and second fill ports and closer to the center of the container than the one of the first and second fill ports is.

6. The image forming apparatus as described in claim 5, wherein the first and second spiral members have different lengths, and wherein the detection unit is arranged in close proximity to one of the first and second fill ports which is closer to a shorter of the first and second spiral members than to the longer of the first and second spiral members.

7. The image forming apparatus as described in claim 5, wherein the first and second spiral members are substantially equal in length.

8. The image forming apparatus as described in claim 5, wherein the first and second ports are provided on an upper surface of the container and at opposite ends of the conveying device.

9. The image forming apparatus as described in claim 1, wherein the detection unit comprises:

a flexible seal provided on an upper surface of the container and configured to be pressed and upwardly bent by the pressed and up-thrust waste toner; and a movable member having one end supported by the container and another end pressed and upwardly displaced by the flexible seal when the flexible seal is upwardly bent.

10. The image forming apparatus as described in claim 1, wherein the container comprises:

a leveling device provided in the container and configured to level an upper surface of the waste toner in the container into a substantially flat surface.

11. An image forming apparatus comprising:

image carrying means for rotating and carrying a toner image thereon;

transfer means for transferring the toner image to a recording medium;

first cleaning means for collecting toner remaining on the image carrying means as waste toner after a primary transfer operation of the toner image from the image carrying means to the transfer means;

second cleaning means for collecting toner remaining in the transfer means as waste toner after a secondary transfer operation of the toner image from the transfer device to the recording medium; and waste toner collecting means for storing and collecting the waste toner, comprising:

storing means for storing the waste toner collected by and conveyed from the first and second cleaning means;

conveying means, provided in the storing means, for horizontally conveying the waste toner in the storing means, and for pressing and up-thrusting the waste toner after an amount of the waste toner reaches a predetermined value; and detection means, provided above a position where the waste toner is pressed and up-thrust by the conveying means, for being pressed and displaced by the pressed and up-thrust waste toner and detected by a sensor.

12. The image forming apparatus as described in claim 11, further comprising:

process cartridge means, detachably provided in the image forming apparatus, for storing the image carrying means and at least one of, a charging means, a development means, and the first cleaning means, wherein the charging means and the development means are configured to form the toner image on the image carrying means according to an electrostatic photography method, and wherein the image carrying means includes a photoconductor.

13. The image forming apparatus as described in claim 11, wherein the storing means comprises:

first fill port means for receiving the waste toner from one of the first and second cleaning means; and second fill port means for receiving the waste toner from the other of the first and second cleaning means, wherein the conveying means comprises screw means for rotating around an axis thereof to convey the waste toner in the storing means toward a center of the storing means, the screw means comprising first spiral means, extending from one end toward a center of the screw means;

and second spiral means, extending from the other end toward the center of the screw means, and wherein the detection means is located above a position where the waste toner conveyed by the first spiral means collides with the waste toner conveyed by the second spiral means.

14. The image forming apparatus as described in claim 13, wherein the first and second ports are provided on an upper surface of the container and at opposite ends of the conveying device.

15. The image forming apparatus as described in claim 11, wherein the storing means comprises:

first fill port means for receiving the waste toner from one of the first and second cleaning means; and second fill port means for receiving the waste toner from the other of the first and second cleaning means, wherein the conveying means comprises screw member means for rotating around an axis thereof to convey the waste toner in the storing means toward a center of the storing means, the screw means comprising first spiral means extending from one end of the screw member means toward a center of the screw member means; and second spiral means extending from the other end of the screw member means toward the center of the screw member means, and having a waste toner conveying ability substantially equal to that of the first spiral means, and wherein the detection means is arranged in close proximity to one of the first and second fill port means and closer to the center of the storing means than the one of the first and second fill port means is.

16. The image forming apparatus as described in claim 15, wherein the first and second ports are provided on an upper surface of the container and at opposite ends of the conveying device.

17. The image forming apparatus as described in claim 15, wherein the first and second spiral means have different lengths, and wherein the detection means is arranged in close proximity to one of the first and second fill port means which is closer to a shorter of the first and second spiral means than the other of the first and second fill port means is.

18. The image forming apparatus as described in claim 15, wherein the first and second spiral means are substantially equal in length.

19. The image forming apparatus as described in claim 11, wherein the detection means comprises:

flexible seal means, provided on an upper surface of the storing means, for being pressed and upwardly bent by the pressed and up-thrust waste toner; and movable means, having one end supported by the storing means and another end pressed and upwardly displaced when the flexible seal means is upwardly bent.

20. The image forming apparatus as described in claim 11, wherein the storing means comprises:

leveling means, provided in the storing means, for leveling an upper surface of the waste toner in the storing means into a substantially flat surface.

21. An image forming method comprising:

rotating an image carrying member configured to carry a toner image thereon;

transferring a toner image from an image carrying member to a transfer device;

transferring the toner image from a transfer device to a recording medium;

collecting, with a first cleaning device, toner remaining on the image carrying member as waste toner after transferring the toner image from the image carrying member to the transfer device;

collecting, with a second cleaning device, toner remaining in the transfer device as waste toner after transfer of the toner image from the transfer device to the recording medium;

storing the waste toner conveyed from the first and second cleaning devices in a container having a detection unit;

conveying the waste toner horizontally in the container with a conveying device to provide pressing and up-thrusting of the waste toner after an amount of the waste toner reaches a predetermined value, displacing the detection unit; and detecting the displacement of the detection unit.

22. The image forming method as described in claim 21, wherein a process cartridge is detachably provided in the image forming apparatus and configured to store the image carrying member, and at least one of the first cleaning device, a charging device, and a development device, wherein the charging device and the development device are configured to form the toner image on the image carrying member according to an electrostatic photography method, and wherein the image carrying member includes a photoconductor.

23. The image forming method as described in claim 21, wherein the container comprises:

a first fill port configured to receive the waste toner from one of the first and second cleaning devices; and a second fill port configured to receive the waste toner from the other one of the first and second cleaning devices, wherein the conveying device comprises a screw member configured to rotate around an axis thereof to convey the waste toner in the container toward a center of the container, the screw member comprising a first spiral member extending from one end of the screw member toward approximately a center of the screw member; and a second spiral member extending from the other end of the screw member toward approximately the center of the screw member, and wherein the detection unit is located above a position where the waste toner conveyed by the first spiral member collides with the waste toner conveyed by the second spiral member.

24. The image forming method as described in claim 23, wherein the first and second ports are provided on an upper surface of the container and at opposite ends of the conveying device.

25. The image forming method as described in claim 21, wherein the container comprises:

a first fill port provided on the container and configured to receive the waste toner from one of the first and second cleaning devices; and a second fill port provided on the container above and configured to receive the waste toner from the other of the first and second cleaning devices, wherein the conveying device comprises a screw member configured to rotate around an axis thereof to convey the waste toner in the container toward a center of the container, the screw member comprising a first spiral member extending from one end toward a center of the screw member; and a second spiral member extending from the other end toward the center of the screw member, and having a waste toner conveying ability substantially equal to that of the first spiral member, and wherein the detection unit is arranged in close proximity to one of the first and second fill ports and closer to the center of the container than the one of the first and second fill ports is.

26. The image forming method as described in claim 25, wherein the first and second ports are provided on an upper surface of the container and at opposite ends of the conveying device.

27. The image forming method as described in claim 25, wherein the first and second spiral members have different lengths, and wherein the detection unit is arranged in close proximity to one of the first and second fill ports which is closer to a shorter of the first and second spiral members than to the longer of the first and second spiral members.

28. The image forming method as described in claim 25, wherein the first and second spiral members are substantially equal in length.

29. The image forming method as described in claim 21, wherein the detection unit comprises:

a flexible seal provided on the container and configured to be pressed and upwardly bent by the pressed and up-thrust waste toner; and a movable member having one end supported by the container and another end pressed and upwardly displaced by the upwardly bent flexible seal.

30. The image forming method as described in claim 21, wherein the container comprises:

a leveling device provided in the container and configured to level an upper surface of the waste toner in the container into a substantially flat surface.

31. A waste toner collecting unit comprising:

a container configured to store waste toner collected by and conveyed from at least two different external cleaning devices;

a conveying device provided in the container and configured to horizontally convey the waste toner in the container and to press and up-thrust the waste toner after an amount of the waste toner reaches a predetermined value; and a detection unit provided above a position where the waste toner is pressed and up-thrust by the conveying device and configured to be pressed and displaced by the pressed and up-thrust waste toner and to be detected by an external sensor.

32. The waste toner collecting unit as described in claim 31, wherein the container comprises:

a first fill port configured to receive the waste toner from one of the two different external cleaning devices; and a second fill port configured to receive the waste toner from the other of the two different external cleaning devices, wherein the conveying device comprises a screw member configured to rotate around an axis thereof to convey the waste toner in the container toward a center of the container, the screw member comprising a first spiral member extending from one end of the screw member to a center of the screw member; and a second spiral member extending from the other end of the screw member to the center of the screw member, and wherein the detection unit is located above a position where the waste toner conveyed by the first spiral member collides with the waste toner conveyed by the second spiral member.

33. The waste toner collecting unit as described in claim 32, wherein the first and second ports are provided on an upper surface of the container and at opposite ends of the conveying device.

34. The waste toner collecting unit as described in claim 31, wherein the container comprises:

a first fill port configured to receive the waste toner from one of the two different external cleaning devices; and a second fill port configured to receive the waste toner from the other one of the two different external cleaning devices, wherein the conveying device comprises a screw member configured to rotate around axis thereof to convey the waste toner in the container toward a center of the container, the screw member comprising a first spiral member extending from one end of the screw member toward a center of the screw member; and a second spiral member extending from the other end of the screw member toward the center of the screw member and having a waste toner conveying ability substantially equal to that of the first spiral member, and wherein the detection unit is arranged in close proximity to one of the first and second fill ports and closer to the center of the container than the one of the first and second fill ports is.

35. The waste toner collecting unit as described in claim 34, wherein the first and second ports are provided on an upper surface of the container and at opposite ends of the conveying device.

36. The waste toner collecting unit as described in claim 34, wherein the first and second spiral members have different lengths, and wherein the detection unit is arranged in close proximity to one of the first and second fill ports which is closer to a shorter of the first and second spiral members than the other of the first and second fill ports is.

37. The waste toner collecting unit as described in claim 34, wherein the first and second spiral members are substantially equal in length.

38. The waste toner collecting unit as described in claim 31, wherein the detection unit comprises:

a flexible seal provided on the container and configured to be pressed and upwardly bent by the pressed and up-thrust waste toner; and a movable member having one end supported by an outer surface of the container and another end pressed and upwardly displaced by the flexible seal when the flexible seal is upwardly bent.

39. The waste toner collecting unit as described in claim 31, wherein the container comprises:

a leveling device provided in the container and configured to level an upper surface of the waste toner in the container into a substantially flat surface.

40. An image forming apparatus comprising:

an image carrying member configured to rotate and carry a toner image thereon;

a transfer device configured to transfer the toner image to a recording medium;

a first cleaning device configured to collect toner remaining on the image carrying member as waste toner after a primary transfer operation of the toner image from the image carrying member to the transfer device;

a second cleaning device configured to collect toner remaining in the transfer device as waste toner after a secondary transfer operation of the toner image from the transfer device to the recording medium;

means for storing the waste toner conveyed from the first and second cleaning devices;

means for conveying the waste toner in the means for storing;

means for pressing the waste toner after an amount of the waste toner reaches a predetermined value; and means for detecting the pressing.

* * * * *